US008853927B2

(12) United States Patent
Nasu et al.

(10) Patent No.: US 8,853,927 B2
(45) Date of Patent: Oct. 7, 2014

(54) SPARK PLUG, AND MAIN METAL FITTING FOR SPARK PLUG

(75) Inventors: Hiroaki Nasu, Gifu (JP); Kazuhiro Kodama, Hekinan (JP)

(73) Assignee: NGK Spark Plug Co., Ltd., Aichi (JP)

( * ) Notice: Subject to any disclaimer, the term of this patent is extended or adjusted under 35 U.S.C. 154(b) by 50 days.

(21) Appl. No.: 13/814,982

(22) PCT Filed: Apr. 12, 2011

(86) PCT No.: PCT/JP2011/002161

§ 371 (c)(1), (2), (4) Date: Feb. 8, 2013

(87) PCT Pub. No.: WO2012/020523

PCT Pub. Date: Feb. 16, 2012

(65) Prior Publication Data

US 2013/0134858 A1 May 30, 2013

(30) Foreign Application Priority Data

Aug. 11, 2010 (JP) ..... 2010-179985

(51) Int. Cl.

| | |
|---|---|
| ***H01T 13/20*** | (2006.01) |
| ***H01T 13/32*** | (2006.01) |
| ***H01T 13/02*** | (2006.01) |
| *F02P 13/00* | (2006.01) |

(52) U.S. Cl.

CPC ..... *H01T 13/02* (2013.01); *H01T 13/32* (2013.01); *F02P 13/00* (2013.01)

USPC ..... 313/141; 313/143

(58) Field of Classification Search

CPC ..... H01T 13/39; H01T 13/20; H01T 13/32

USPC ..... 313/141, 143, 118

See application file for complete search history.

(56) References Cited

U.S. PATENT DOCUMENTS

| | | | | |
|---|---|---|---|---|
| 4,967,116 | A | 10/1990 | Oshima | 313/141 |
| 7,109,645 | B2 | 9/2006 | Suzuki et al. | 313/118 |
| 8,421,324 | B2 * | 4/2013 | Nasu et al. | 313/141 |
| 8,716,924 | B2 * | 5/2014 | Nasu et al. | 313/141 |

(Continued)

FOREIGN PATENT DOCUMENTS

| | | | |
|---|---|---|---|
| CN | 1627578 | 6/2005 | C23C 22/53 |
| CN | 102792536 | 11/2012 | C23C 28/00 |

(Continued)

OTHER PUBLICATIONS

International Search Report for International Application No. PCT/JP2011/002161, Jul. 19, 2011.

(Continued)

*Primary Examiner* — Karabi Guharay

(74) *Attorney, Agent, or Firm* — Kusner & Jaffe

(57) ABSTRACT

A spark plug superior in salt corrosion resistance and stress corrosion cracking resistance is provided. The spark plug includes a metallic shell coated with a composite layer which includes a nickel plating layer and a chromate layer formed on the nickel plating layer. The spark plug is characterized in that the nickel plating layer has a thickness A which satisfies a relational expression 3 μm≤A≤15 μm and that the chromate layer has a thickness B which satisfies a relational expression 2 nm≤B≤45 nm.

4 Claims, 5 Drawing Sheets

(56) References Cited

U.S. PATENT DOCUMENTS

| | | | | |
|---|---|---|---|---|
| 2003/0214208 | A1* | 11/2003 | Nasu et al. | 313/11.5 |
| 2006/0257680 | A1 | 11/2006 | Kodaira et al. | 428/615 |
| 2013/0002120 | A1 | 1/2013 | Nasu et al. | 313/118 |

FOREIGN PATENT DOCUMENTS

| | | | |
|---|---|---|---|
| DE | 3841215 | 6/1989 | C25D 11/38 |
| EP | 0 319 908 | 12/1988 | C25D 11/38 |
| JP | 1-92092 | 6/1989 | H01T 13/20 |
| JP | 2002-184552 | 6/2002 | H01T 13/36 |
| WO | WO 2011/111128 | 9/2011 | H01T 20/02 |

OTHER PUBLICATIONS

Extended European Search Report for corresponding EP 11816193.4, Jul. 17, 2014.

Lou et al., "Electroplating," Encyclopedia of Chemical Processing, Dec. 31, 2006, pp. 1-10.

* cited by examiner

FIG. 4(a)

Effects of Ni plating layer thickness and chromate layer thickness

| Sample No. | S1 | S2 | S3 | S4 | S5 | S6 | S7 | S8 | S9 | S10 | S11 | S12 | S13 | S14 |
|---|---|---|---|---|---|---|---|---|---|---|---|---|---|---|
| Ni plating thickness (μm) | 2 | 3 | 4 | 5 | 9 | 15 | 16 | 2 | 3 | 4 | 5 | 9 | 15 | 16 |
| Chromate film thickness (μm) | 1 | | | | | | | 2 | | | | | | |
| Plating peeling resistance | A | A | A | A | A | A | F | A | A | A | A | A | A | F |
| Salt corrosion resistance | F | C | B | A | A | A | A | F | C | B | A | A | A | A |
| Stress corrosion cracking resistance | F | F | F | F | F | F | F | C | C | C | C | C | C | C |
| Overall evaluation | F | F | F | F | F | F | F | F | C | C | C | C | C | F |

| Sample No. | S15 | S16 | S17 | S18 | S19 | S20 | S21 | S22 | S23 | S24 | S25 | S26 | S27 | S28 |
|---|---|---|---|---|---|---|---|---|---|---|---|---|---|---|
| Ni plating thickness (μm) | 2 | 3 | 4 | 5 | 9 | 15 | 16 | 2 | 3 | 4 | 5 | 9 | 15 | 16 |
| Chromate film thickness (μm) | 10 | | | | | | | 20 | | | | | | |
| Plating peeling resistance | A | A | A | A | A | A | F | A | A | A | A | A | A | F |
| Salt corrosion resistance | F | C | B | A | A | A | A | F | C | B | A | A | A | A |
| Stress corrosion cracking resistance | B | B | B | B | B | B | B | A | A | A | A | A | A | A |
| Overall evaluation | F | C | C | C | C | C | F | F | B | B | A | A | A | F |

[Criteria]

•Corrosion resistance
(After 48-hour spray of salt water)
A: No formation of red rust
B: Formation of red rust 5% or less
C: Formation of red rust 10% or less
F: Formation of red rust greater than 10%

•Plating peeling resistance
A: No lifting or peeling of plating
F: Occurrence of lifting or peeling of plating

•Stress corrosion cracking resistance
(Elapse of time before cracking in groove portion)
A: In excess of 80 hrs
B: 50-80 hrs
C: 20-50 hrs
F: 20 hrs or less

•Overall evaluation
A: 3 As, No F
B: 2 As, No F
C: 1 A, No F
F: 1 or more Fs

FIG. 4(b)

Effects of Ni plating layer thickness and chromate layer thickness

| Sample No. | S29 | S30 | S31 | S32 | S33 | S34 | S35 | S36 | S37 | S38 | S39 | S40 | S41 | S42 |
|---|---|---|---|---|---|---|---|---|---|---|---|---|---|---|
| Ni plating thickness (μm) | 2 | 3 | 4 | 5 | 9 | 15 | 16 | 2 | 3 | 4 | 5 | 9 | 15 | 16 |
| Chromate film thickness (μm) | 40 | | | | | | | 45 | | | | | | |
| Plating peeling resistance | A | A | A | A | A | A | F | A | A | A | A | A | A | F |
| Salt corrosion resistance | F | C | B | A | A | A | A | F | C | B | A | A | A | A |
| Stress corrosion cracking resistance | A | A | A | A | A | A | A | A | A | A | A | A | A | A |
| Overall evaluation | F | B | B | A | A | A | F | F | B | B | A | A | A | F |

| Sample No. | S43 | S44 | S45 | S46 | S47 | S48 | S49 |
|---|---|---|---|---|---|---|---|
| Ni plating thickness (μm) | 2 | 3 | 4 | 5 | 9 | 15 | 16 |
| Chromate film thickness (μm) | 50 | | | | | | |
| Plating peeling resistance | A | A | A | A | A | A | F |
| Salt corrosion resistance | F | C | B | A | A | A | A |
| Stress corrosion cracking resistance | F | F | F | F | F | F | F |
| Overall evaluation | F | F | F | F | F | F | F |

[Criteria]

•Corrosion resistance
(After 48-hour spray of salt water)
A: No formation of red rust
B: Formation of red rust 5% or less
C: Formation of red rust 10% or less
F: Formation of red rust greater than 10%

•Plating peeling resistance
A: No lifting or peeling of plating
F: Occurrence of lifting or peeling of plating

•Stress corrosion cracking resistance
(Elapse of time before cracking in groove portion)
A: In excess of 80 hrs
B: 50-80 hrs
C: 20-50 hrs
F: 20 hrs or less

•Overall evaluation
A: 3 As, No F
B: 2 As, No F
C: 1 A, No F
F: 1 or more Fs

SPARK PLUG, AND MAIN METAL FITTING FOR SPARK PLUG

FIELD OF THE INVENTION

The present invention relates to a spark plug for an internal combustion engine.

BACKGROUND OF THE INVENTION

A spark plug for providing ignition in an internal combustion engine, such as a gasoline engine, has the following structure: an insulator is provided externally of a center electrode; a metallic shell (main metal fitting) is provided externally of the insulator; and a ground electrode which forms a spark discharge gap in cooperation with the center electrode is attached to the metallic shell. The metallic shell is generally formed from an iron-based material, such as carbon steel, and, in many cases, plating is performed on its surface for corrosion protection. A known technique for performing such plating forms a plating layer having a 2-layer structure consisting of an Ni plating layer and a chromate layer (Japanese Patent Application Laid-Open (kokai) No. 2002-184552, "Patent Document 1").

Problems to be Solved by the Invention

According to the technique for forming a plating layer having 2-layer structure, a plating process is performed before a crimping process. In the crimping process, an insulator to which a center electrode is attached is inserted into a hollow portion of a hollow, cylindrical metallic shell; then, a portion of the metallic shell is crimped inward (toward the insulator), thereby fixing the metallic shell to the insulator. This crimping process has involved a problem in which an associated deformation of the metallic shell causes cracking or peeling of the plating layer, resulting in deterioration in salt corrosion resistance. Also, the crimping process has involved the following problem: because of residual stress in the metallic shell stemming from the crimping process or an increase in hardness the metallic shell associated with a microstructural change caused by heating in hot crimping, stress corrosion cracking arises in a portion which has high hardness and where a large residual stress exists. However, conventionally, sufficient measures have not been devised for attaining a spark plug superior in salt corrosion resistance and stress corrosion cracking resistance.

An object of the present invention is to provide a spark plug superior in salt corrosion resistance and stress corrosion cracking resistance.

SUMMARY OF THE INVENTION

Means for Solving the Problems

The present invention has been conceived to solve, at least partially, the above problems and can be embodied in the following modes or application examples.

[Application example 1] A spark plug comprising a metallic shell coated with a composite layer which includes a nickel plating layer and a chromate layer formed on the nickel plating layer, characterized in that the nickel plating layer has a thickness A which satisfies a relational expression 3 μm≤A≤15 μm and that the chromate layer has a thickness B which satisfies a relational expression 2 nm≤B≤45 nm.

[Application example 2] A spark plug described in application example 1, wherein the thickness B satisfies a relational expression 20 nm≤B≤45 nm.

[Application example 3] A spark plug described in application example 2, wherein the thickness A satisfies a relational expression 5 μm≤A≤15 μm.

[Application example 4] A metallic shell for a spark plug, coated with a composite layer which includes a nickel plating layer and a chromate layer formed on the nickel plating layer, characterized in that the nickel plating layer has a thickness A which satisfies a relational expression 3 μm≤A≤15 μm and that the chromate layer has a thickness B which satisfies a relational expression 2 nm≤B≤45 nm.

The present invention can be implemented in various forms. For example, the present invention can be implemented in a method of manufacturing a spark plug and a method of manufacturing a metallic shell.

Effects of the Invention

In the spark plug of application example 1, since the thickness A of the nickel plating layer of the metallic shell is not less than 3 μm, there can be restrained the formation of a plating-repellant portion (pinhole) which could otherwise result from a situation in which oil or the like that has adhered to the surface of the metallic shell before formation of the nickel plating layer remains incompletely removed due to insufficient cleaning, whereby salt corrosion resistance can be enhanced. Additionally, since the thickness A of the nickel plating layer is not greater than 15 μm, there can be restrained cracking of the nickel plating layer which could otherwise result from a large thickness, whereby plating peeling resistance can be enhanced. Therefore, salt corrosion resistance can be enhanced. Also, since a thickness range smaller than a relatively small thickness of 2 nm is excluded for the thickness B of the chromate layer, there can be restrained a fracture of the chromate layer which could otherwise result from residual stress associated with crimping. Additionally, since thickness range greater than a relatively large thickness of 45 nm is excluded for the thickness B of the chromate layer, there can be restrained the occurrence of cracking during working which could otherwise result from poor adhesion to the metallic shell (the nickel plating layer). Therefore, stress corrosion cracking resistance can be enhanced. Thus, a spark plug superior in salt corrosion resistance and stress corrosion cracking resistance can be provided.

Employment of the configuration of application example 2 can further enhance stress corrosion cracking resistance.

Employment of the configuration of application example 3 can further enhance plating peeling resistance and salt corrosion resistance.

In the metallic shell of application example 4, since the thickness A of the nickel plating layer is not less than 3 μm, there can be restrained the formation of a plating-repellant portion (pinhole) which could otherwise result from a situation in which oil or the like that has adhered to the surface of the metallic shell before formation of the nickel plating layer remains incompletely removed due to insufficient cleaning, whereby salt corrosion resistance can be enhanced. Additionally, since the thickness A of the nickel plating layer is not greater than 15 μm, there can be restrained cracking of the nickel plating layer which could otherwise result from a large thickness, whereby plating peeling resistance can be enhanced. Therefore, salt corrosion resistance can be enhanced. Also, since a thickness range smaller than a relatively small thickness of 2 nm is excluded for the thickness B of the chromate layer, there can be restrained a fracture of the chromate layer which could otherwise result from residual stress associated with crimping. Additionally, since a thickness range greater than a relatively large thickness of 45 nm is excluded for the thickness B of the chromate layer, there can be restrained the occurrence of cracking during working which could otherwise result from poor adhesion to the metallic shell (the nickel plating layer). Therefore, stress corrosion cracking resistance can be enhanced. Thus, by use of the metallic shell of application example 4, a spark plug superior in salt corrosion resistance and stress corrosion cracking resistance can be provided.

BRIEF DESCRIPTION OF THE DRAWINGS

FIGS. 4(*a*) and 4(*b*) are explanatory views showing the results of tests for plating peeling resistance, salt corrosion resistance, and stress corrosion cracking resistance with respect to 49 samples S1 to S49 prepared under the above-mentioned processing conditions.

DETAILED DESCRIPTION OF THE INVENTION

A. Configuration of Spark Plug

Figure 1:
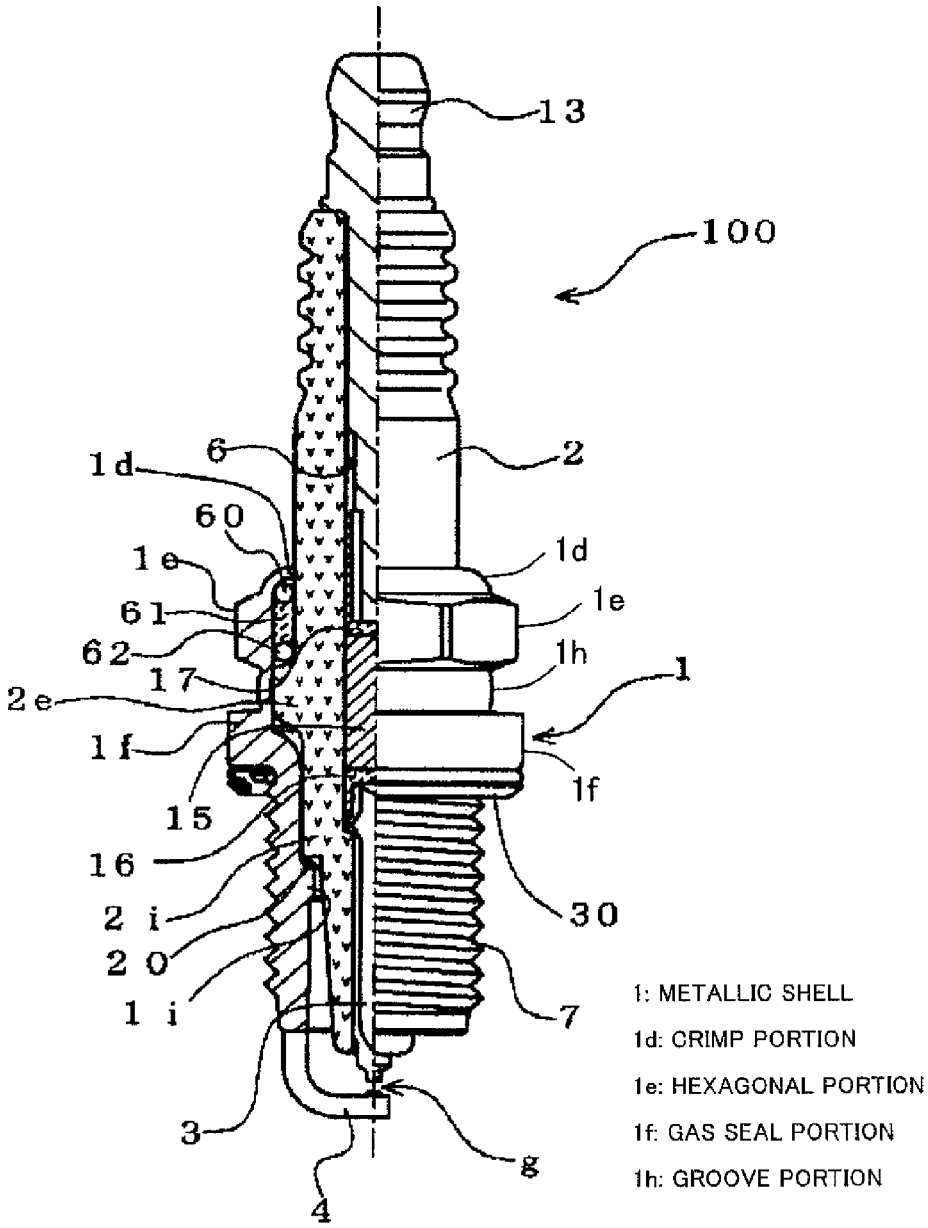
FIG. 1 is a sectional view of essential members, showing the structure of a spark plug according to an embodiment of the present invention.

FIG. 1 is a sectional view of essential members, showing the structure of a spark plug according to an embodiment of the present invention. A spark plug 100 includes a tubular metallic shell 1; a tubular insulator 2, which is fitted into the metallic shell 1 in such a manner that its forward end portion projects from the metallic shell 1; a center electrode 3, which is provided in the insulator 2 in such a state that its forward end portion projects from the insulator 2; and a ground electrode 4 whose one end is joined to the metallic shell 1 and whose other end faces the forward end of the center electrode 3. A spark discharge gap g is formed between the ground electrode 4 and the center electrode 3.

The insulator 2 is formed from, for example, a ceramic sintered body of alumina or aluminum nitride and has a through hole 6 formed therein in such a manner as to extend along the axial direction thereof, and adapted to allow the center electrode 3 to be fitted therein. A metal terminal 13 is fixedly inserted into the through hole 6 at a side toward one end of the through hole 6, whereas the center electrode 3 is fixedly inserted into the through hole 6 at a side toward the other end of the through hole 6. A resistor 15 is disposed, within the through hole 6, between the metal terminal 13 and the center electrode 3. Opposite end portions of the resistor 15 are electrically connected to the center electrode 3 and the metal terminal 13 via electrically conductive glass seal layers 16 and 17, respectively.

The metallic shell 1 is formed into a hollow, cylindrical shape from a metal, such as carbon steel, and forms a housing of the spark plug 100. The metallic shell 1 has a threaded portion 7 formed on its outer circumferential surface and adapted to mount the spark plug 100 to an unillustrated engine block. A hexagonal portion 1*e* is a tool engagement portion which allows a tool, such as a spanner or a wrench, to be engaged therewith in mounting the metallic shell 1 to the engine block, and has a hexagonal cross section. In a space between the outer surface of the insulator 2 and the inner surface of a rear (upper in the drawing) opening portion of the metallic shell 1, a ring packing 62 is disposed on the rear periphery of a flange-like projection 2*e* of the insulator 2, and a filler layer 61, such as talc, and a ring packing 60 are disposed, in this order, rearward of the ring packing 62. In assembling work, the insulator 2 is pressed forward (downward in the drawing) into the metallic shell 1, and, in this condition, the rear opening end of the metallic shell 1 is crimped inward toward the ring packing 60 (and, in turn, toward the projection 2*e*, which functions as a receiving portion for crimping), whereby a crimp portion 1*d* is formed, and thus the metallic shell 1 is fixed to the insulator 2.

A gasket 30 is fitted to a proximal end of the threaded portion 7 of the metallic shell 1. The gasket 30 is formed by bending a metal sheet of carbon steel or the like into the form of a ring. When the threaded portion 7 is screwed into a threaded hole of the cylinder head, the gasket 30 is compressed in the axial direction and deformed in a crushed manner between a flange-like gas seal portion 1*f* of the metallic shell 1 and a peripheral-portion-around-opening of the threaded hole, thereby sealing the gap between the threaded hole and the threaded portion 7.

Figure 2:
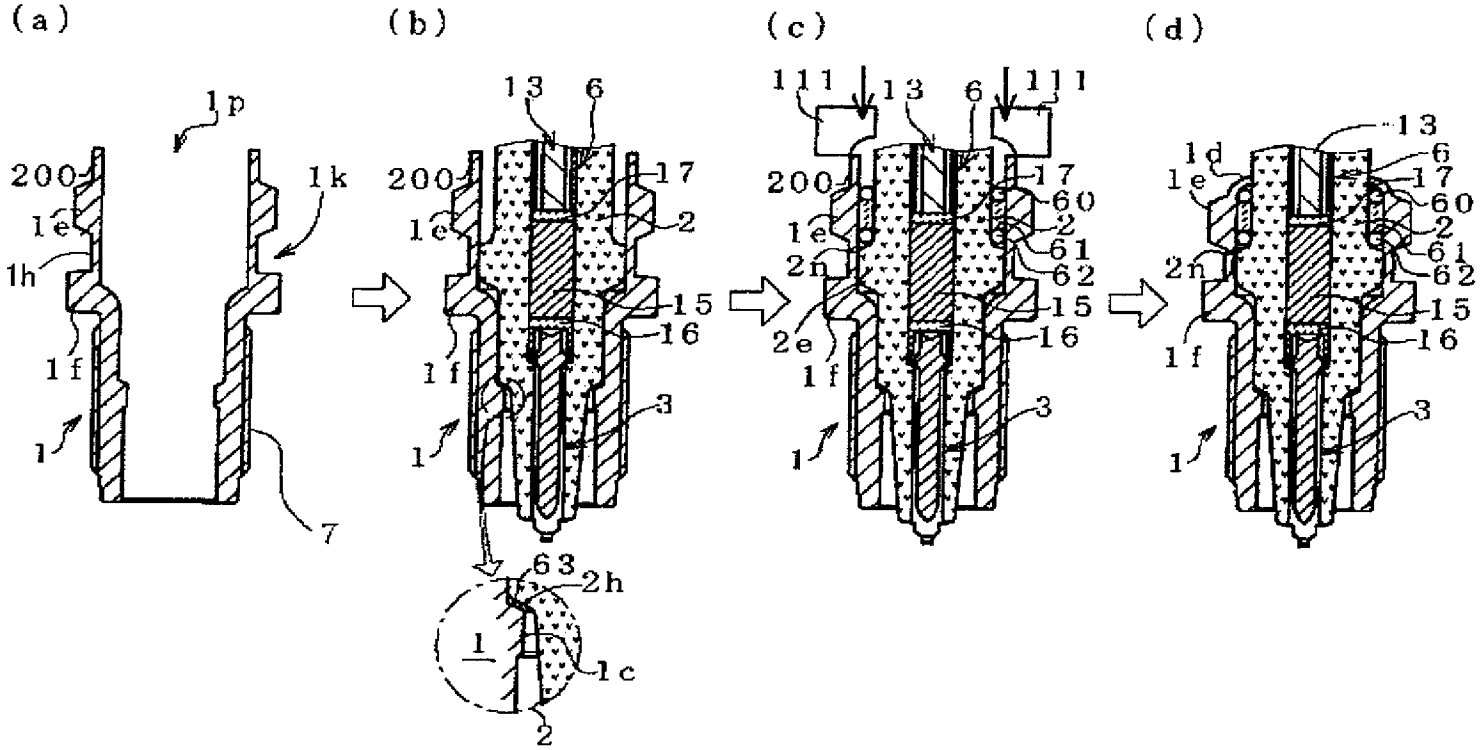
FIG. 2 is an explanatory view showing an example step of fixing a metallic shell 1 to an insulator 2 through crimping.

FIG. 2 is an explanatory view showing an example step of fixing the metallic shell 1 to the insulator 2 through crimping. FIG. 2 omits the illustration of the ground electrode 4. First, as shown in FIG. 2(*b*), the insulator 2 whose through hole 6 accommodates the center electrode 3, the electrically conductive glass seal layers 16 and 17, the resistor 15, and the metal terminal 13 is inserted into the metallic shell 1 shown in FIG. 2(*a*) from an insertion opening portion 1*p* (where a prospective crimp portion 200 which will become the crimp portion 1*d* is formed) at the rear end of the metallic shell 1, thereby establishing a state in which an engagement portion 2*h* of the insulator 2 and an engagement portion 1*c* of the metallic shell 1 are engaged together via a sheet packing 63.

Then, as shown in FIG. 2(*c*), the ring packing 62 is disposed inside the metallic shell 1 through the insertion opening portion 1*p*; subsequently, the filler layer 61 of talc or the like is formed; and, furthermore, the ring packing 60 is disposed. Then, by means of a crimping die 111, the prospective crimp portion 200 is crimped to an end surface 2*n* of the projection 2*e*, which functions as a receiving portion for crimping, via the ring packing 62, the filler layer 61, and the ring packing 60, thereby forming the crimp portion 1*d* and fixing the metallic shell 1 to the insulator 2 through crimping as shown in FIG. 2(*d*). At this time, in addition to the crimp portion 1*d*, a groove portion 1*h* (FIG. 1) located between the hexagonal portion 1*e* and the gas seal portion 1*f* is also deformed under a compressive stress associated with crimping. The reason for this is that the crimp portion 1*d* and the groove portion 1*h* are thinnest portions in the metallic shell 1. The groove portion 1*h* is also called the "thin-walled portion." After the step of FIG. 2*d*), the ground electrode 4 is bent toward the center electrode 3 so as to form the spark discharge gap g, thereby completing the spark plug 100 of FIG. 1. The crimping step described with reference to FIG. 2 is of cold crimping; however, hot crimping can also be employed.

B. Plating Process

Figure 3:
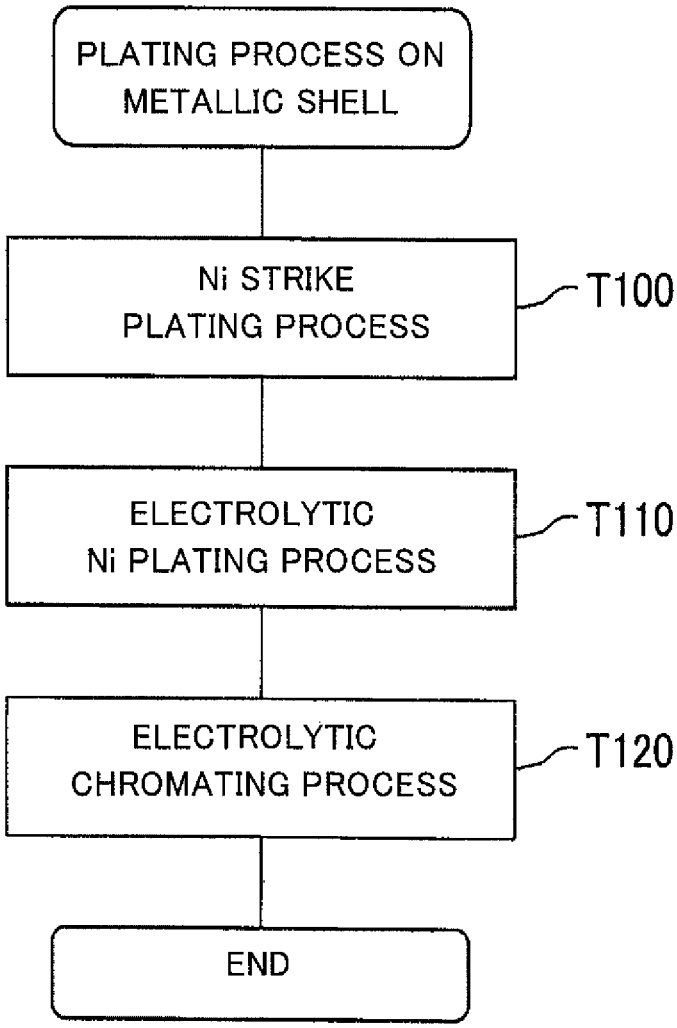
FIG. 3 is a flowchart showing the procedure of the plating process for the metallic shell.

In manufacture of the spark plug 100, before the above-mentioned crimping step, a plating process is performed on the metallic shell 1. FIG. 3 is a flowchart showing the procedure for the plating process for the metallic shell. In step T100, nickel strike plating is performed. Nickel strike plating is performed for cleaning the surface of the metallic shell formed from carbon steel and for improving adhesion between plating and a base metal. However, nickel strike plating may be omitted. Usually employed processing conditions can be employed for nickel strike plating. A specific example of preferable processing conditions is as follows.

<Example of Processing Conditions of Nickel Strike Plating>

Composition of plating bath
Nickel chloride: 150-600 g/L
35% hydrochloric acid: 50-300 ml/L
Solvent: Deionized water
Processing temperature (bath temperature): 25-40° C.
Cathode current density: 0.2-0.4 A/dm$^2$
Processing time; 5-20 minutes In step T110, an electrolytic nickel plating process is performed. The electrolytic nickel plating process can be a barrel-type electrolytic nickel plating process which uses a rotary barrel, and may employ another plating method, such as a stationary plating method. Usually employed processing conditions can be employed for electrolytic nickel plating. A specific example of preferable processing conditions is as follows.

<Example of Processing Conditions of Electrolytic Nickel Plating>

Composition of plating bath
Nickel sulfate: 100-400 g/L
Nickel chloride: 20-60 g/L
Boric acid: 20-60 g/L
Solvent: Deionized water
Bath pH: 2.0-4.8
Processing temperature (bath temperature): 25-60° C.
Cathode current density: 0.2-0.4 A/dm$^2$
Processing time: 24-192 minutes In step T120, an electrolytic chromating process is performed. The electrolytic chromating process can also use a rotary barrel and may employ another plating method, such as a stationary plating method. An example of preferable processing conditions of the electrolytic chromating process is as follows.

<Example of Processing Conditions of Electrolytic Chromating Process>

Composition of processing bath (chromating processing solution)
Sodium dichromate: 20-70 g/L
Solvent: Deionized water
Bath pH: 2-6
Processing temperature (bath temperature): 20-60° C.
Cathode current density: 0.01-0.50 A/dm$^2$ (preferably 0.02-0.45 A/dm$^2$)
Processing time: 1-10 minutes A usable dichromate other than sodium dichromate is potassium dichromate. Another combination of processing conditions (amount of dichromate, cathode current density, processing time, etc.) different from the above may be employed according to a desired thickness of the chromate layer.

By performing the above plating processes, a film of 2-layer structure consisting of the nickel plating layer and the chromate layer is formed on the outer and inner surfaces of the metallic shell. Another protection film can be formed on the film of 2-layer structure. For example, there can be formed a film of seizure inhibitor which contains C (mineral oil or graphite) and one or more components selected from among Al, Ni, Zn, and Cu. Through formation of a seizure inhibitor film, when the engine head is heated to a high temperature, there can be restrained seizure between the spark plug and the engine head. Also, for example, there can be formed a film of rust prevention oil which contains at least one of C, Ba, Ca, and Na. After a multilayered protection film is formed as mentioned above, the metallic shell is fixed to the insulator, etc., by the crimping step, thereby completing the spark plug.

C. Example

C1. Processing Conditions

The metallic shells 1 were manufactured, by cold forging, from a carbon steel wire SWCH17K for cold forging specified in JIS G3539. The ground electrodes 4 were welded to the respective metallic shells 1, followed by degreasing and water washing. Subsequently, a nickel strike plating process was performed under the following processing conditions by use of a rotary barrel.

<Processing Conditions of Nickel Strike Plating>

Composition of plating bath
Nickel chloride: 300 g/L
35% hydrochloric acid: 100 ml/L
Processing temperature (bath temperature): 30±5° C.
Cathode current density: 0.3 A/dm$^2$
Processing time: 15 minutes Next, an electrolytic nickel plating process was performed under the following processing conditions by use of the rotary barrel, thereby forming nickel plating layers. The nickel (Ni) content (% by mass) of the nickel plating layers was 98% or higher.

<Processing Conditions of Electrolytic Nickel Plating>

Composition of plating bath
Nickel sulfate: 250 g/L
Nickel chloride: 50 g/L
Boric acid: 40 g/L
Bath pH: 4.0
Processing temperature (bath temperature): 55±5° C.
Cathode current density: 0.3 A/dm$^2$
Processing time: 24-192 minutes In the present example, there were prepared seven types of samples which differed in the thickness of the nickel plating layer as effected through control of the thickness of the nickel plating layer by means of the processing time of plating. Specifically, there were prepared seven types of samples which differed in the thickness of the nickel plating layer as effected by means of the following seven types of processing time. "The thickness of the nickel plating layer" means the total thickness of the thickness of a layer formed by the above-mentioned nickel strike plating process and the thickness of a layer formed by the above-mentioned electrolytic nickel plating process.

Processing time: 24 minutes
Nickel plating layer thickness: 2 μm
Processing time: 36 minutes
Nickel plating layer thickness: 3 μm
Processing time: 48 minutes
Nickel plating layer thickness: 4 μm
Processing time: 60 minutes
Nickel plating layer thickness: 5 μm
Processing time: 108 minutes
Nickel plating layer thickness: 9 μm
Processing time; 180 minutes
Nickel plating layer thickness: 15 μm
Processing time: 192 minutes
Nickel plating layer thickness: 16 μm The relationship between processing time and the thickness of the nickel plating layer was experimentally obtained beforehand. The thickness of the nickel plating layer was measured by use of a fluorescent X-ray film thickness meter under the following conditions: beam diameter of X ray: 0.2 mm; and radiation time: 10 seconds.

Next, an electrolytic chromating process was performed by use of a rotary barrel under the following processing conditions, thereby forming a chromate layer on the nickel plating layer.

<Processing Conditions of Electrolytic Chromating Process>

Composition of processing bath (chromating processing solution)
Sodium dichromate: 40 g/L
Solvent: Deionized water
Processing temperature (bath temperature): 35±5° C.
Cathode current density: 0.01 A/dm$^2$-0.50 A/dm$^2$
Processing time: 5 minutes In the present embodiment, there were prepared seven types of samples which differed in the thickness of the chromate layer as effected through control of the thickness of the chromate layer by means of the cathode current density. Specifically, there were prepared seven types of samples which differed in the thickness of the chromate layer as effected by means of the following seven types of cathode current density.

Cathode current density: 0.01 A/dm$^2$
Chromate layer thickness: 1 nm
Cathode current density: 0.02 A/dm$^2$
Chromate layer thickness: 2 nm
Cathode current density: 0.10 A/dm$^2$
Chromate layer thickness: 10 nm
Cathode current density: 0.20 A/dm$^2$
Chromate layer thickness: 20 nm
Cathode current density: 0.40 A/dm$^2$
Chromate layer thickness: 40 nm
Cathode current density: 0.45 A/dm$^2$
Chromate layer thickness: 45 nm
Cathode current density: 0.50 A/dm$^2$
Chromate layer thickness: 50 nm The relationship between cathode current density and the thickness of the chromate layer was experimentally obtained beforehand. The thickness of the chromate layer was measured as follows. First, a small specimen was cut out from near the outer surface of each of the samples by use of a focused iron beam machining apparatus (FIB machining apparatus). Then, by use of a scanning transmission electron microscope (STEM), the small specimen was analyzed at an acceleration voltage of 200 kV, thereby obtaining a color map image of Cr elements with respect to the vicinity of the outer surface on a cross section (a section perpendicular to the center axis represented by the dot-dash line in FIG. 1) of the metallic shell. From this color map image, the thickness of the chromate layer was measured.

There were prepared 49 (7 types×7 types) metallic shell samples (S1 to S49) which differed in the thickness of the nickel plating layer and in the thickness of the chromate layer as effected through processing under the above-mentioned conditions. The samples S1 to S49 were tested for evaluation of salt corrosion resistance, plating peeling resistance, and stress corrosion cracking resistance.

C2. Evaluation Test Conditions

<Salt Corrosion Resistance Test>

The neutral salt spray test specified in JIS H8502 was conducted for evaluation of salt corrosion resistance. In this test, after a 48-hour salt spray test, there was measured the percentage of a red-rusted area to the surface area of the metallic shell of a sample. The percentage of a red-rusted area was calculated as follows: a sample after the test was photographed; there were measured a red-rusted area Sa in the photograph and an area Sb of the metallic shell in the photograph; and the ratio Sa/Sb was calculated, thereby obtaining the percentage of the red-rusted area.

<Plating Peeling Resistance Test>

The evaluation test for plating peeling resistance was conducted as follows. After the metallic shells of the samples underwent a chromating process, the insulators, etc., were fixed by crimping. Subsequently, the crimp portions 1*d* were inspected for a state of plating to see if lifting or peeling of plating was present.

<Stress Corrosion Cracking Resistance Test>

In order to evaluate stress corrosion cracking resistance, the following accelerated corrosion test was conducted. Four holes each having a diameter of about 2 mm were cut in the groove portions 1*h* (FIG. 1) of the samples (metallic shells); subsequently, the insulators, etc., were fixed by crimping. The holes were cut for allowing entry of a corrosive solution for test into the metallic shells. The test conditions of the accelerated corrosion test are as follows.

[Test Conditions of Accelerated Corrosion Test (Stress Corrosion Cracking Resistance Test)]

Composition of corrosive solution
Calcium nitrate tetrahydrate: 1,036 g
Ammonium nitrate: 36 g
Potassium permanganate: 12 g
Pure water: 116 g
pH: 3.5-4.5
Processing temperature: 30-40° C.

The reason for adding potassium permanganate as an oxidizer into the corrosive solution is to accelerate the corrosion test.

After the 10-hour test under the above-mentioned test conditions, the samples were taken out from the corrosive solution. Then, the groove portions 1*h* of the samples were externally examined by use of a magnifier to see if cracking was generated in the groove portions 1*h*. When the samples were found to be free from cracking, the corrosive solution was replaced with a new one; then, the samples underwent the accelerated corrosion test under the same conditions for another 10 hours. The test was repeated until the cumulative test time reached 80 hours. As a result of the crimping step, a large residual stress is generated in the groove portions 1*h*. Therefore, by means of the accelerated corrosion test, the groove portions 1*h* can be evaluated for stress corrosion cracking resistance.

C3. Test Results

FIGS. 4(*a*) and 4(*b*) are explanatory views showing the results of tests for plating peeling resistance, salt corrosion resistance, and stress corrosion cracking resistance with respect to 49 samples S1 to S49 prepared under the above-mentioned processing conditions.

As shown in FIGS. 4(*a*) and 4(*b*), regarding plating peeling resistance, substantially the same results were yielded in all thickness cases of the chromate layer. Specifically, in all thickness cases of the chromate layer, lifting or peeling of plating did not arise at a nickel plating layer thickness of 2 μm to 15 μm; however, lifting or peeling of plating arose at a nickel plating layer thickness of 16 μm (samples S7, S14, S21, S28, S35, S42, and S49). Therefore, in view of plating peeling resistance, preferably, the nickel plating layer has a thickness of 2 μm to 15 μm. Conceivably, this is for the following reason: when the nickel plating layer has an excessively large thickness, the plating layer is apt to crack even under a small stress.

Regarding salt corrosion resistance, substantially the same results were yielded in all thickness cases of the chromate layer. Specifically, in all thickness cases of the chromate layer, the formation of red rust was restrained to 10% or less at a nickel plating layer thickness of 3 μm to 16 μm; however, the formation of red rust exceeded 10% at a nickel plating layer thickness of 2 μm (samples S2, S8, S15, S22, S29, S36, and S43). Therefore, in view of salt corrosion resistance, preferably, the nickel plating layer has a thickness of 3 μm to 16 μm. Conceivably, this is for the following reason: when the nickel plating layer has an excessively small thickness, a plating-repellant portion (pinhole) is formed from a situation in which oil, stain, or the like that has adhered to the surface of the metallic shell remains incompletely removed due to insufficient cleaning; consequently, rust is formed at and propagates from such a portion.

Regarding stress corrosion cracking resistance, substantially the same results were yielded in all thickness cases of the nickel plating layer. Specifically, in all thickness cases of the nickel plating layer, cracking was not generated in the groove portion 1*h* at a chromate layer thickness of 2 nm to 45 nm at a cumulative test time of 20 hours or less; however, cracking was generated in the groove portion 1*h* at a chromate layer thickness of 1 nm (samples S1 to S7) and 50 nm (samples S43 to S49) at a cumulative test time of 20 hours or less. Therefore, in view of stress corrosion cracking resistance, preferably, the chromate layer has a thickness of 2 nm to 45 nm. More preferably, the chromate film has a thickness of 20 nm to 45 nm (samples S22 to S42), since cracking is not generated at a cumulative test time of 80 hours or less.

In the case where the chromate layer has a small thickness (1 nm), stress corrosion cracking resistance is poor, conceivably, for the following reason: since the chromate layer is excessively thin, the chromate layer is apt to be destroyed by residual stress. In the case where the chromate layer has a large thickness (50 nm), stress corrosion cracking resistance is poor, conceivably, for the following reason: since the chromate layer is thick, adhesion to the metallic shell deteriorates; consequently, cracking is apt to arise in the course of working, such as crimping.

According to comprehensive evaluation of the above test results regarding plating peeling resistance, salt corrosion resistance, and stress corrosion cracking resistance, most preferably, the nickel plating layer has a thickness of 5 μm to 15 μm, and the chromate layer has a thickness of 20 nm to 45 nm. The samples S25 to S27, S32 to S34, and S39 to S41 which satisfy these conditions have made the best marks in all the tests.

DESCRIPTION OF REFERENCE NUMERALS

1: metallic shell
1*c*: engagement portion
1*d*: crimp portion
1*e*: hexagonal portion
1*f*: gas seal portion (flange portion)
1*h*: groove portion (thin-walled portion)
1*p*: insertion opening portion
2: insulator
2*e*: projection
2*h*: engagement portion
2*n*: end surface
3: center electrode
4: ground electrode
6: through hole
7: threaded portion
13: metal terminal
15: resistor
16, 17: electrically conductive glass seal layer
30: gasket
60: ring packing
61: filler layer
62: ring packing
63: sheet packing
100: spark plug
111: die
200: prospective crimp portion Having described the invention, the following is claimed:

1. A spark plug comprising a metallic shell coated with a composite layer which includes a nickel plating layer and a chromate layer formed on the nickel plating layer, characterized in that:

the nickel plating layer has a thickness A which satisfies a relational expression 3 μm≤A≤15 μm, and the chromate layer has a thickness B which satisfies a relational expression 2 nm≤B≤45 nm.

2. A spark plug according to claim 1, wherein the thickness B satisfies a relational expression 20 nm≤B≤45 nm.

3. A spark plug according to claim 2, wherein the thickness A satisfies a relational expression 5 μm≤A≤15 μm.

4. A metallic shell for a spark plug, coated with a composite layer which includes a nickel plating layer and a chromate layer formed on the nickel plating layer, characterized in that:

the nickel plating layer has a thickness A which satisfies a relational expression 3 μm≤A≤15 μm, and the chromate layer has a thickness B which satisfies a relational expression 2 nm≤B≤45 nm.

* * * * *